US005462373A

United States Patent [19]

Chia

[11] Patent Number: 5,462,373

[45] Date of Patent: Oct. 31, 1995

[54] SHEET ADVANCEMENT SYSTEM WITH PHASE-ADJUSTABLE ROLLER ARRANGEMENT

[75] Inventor: Keng S. Chia, Singapore, Singapore

[73] Assignee: Hewlett-Packard Company, Palo Alto, Calif.

[21] Appl. No.: 237,520

[22] Filed: May 3, 1994

[51] Int. Cl.[6] ..... B41J 11/58

[52] U.S. Cl. ..... 400/62.4; 400/625; 271/114; 271/120

[58] Field of Search ..... 400/624, 625, 400/637.1, 636.33, 641; 271/114, 120, 119, 10

[56] References Cited

U.S. PATENT DOCUMENTS

| | | | |
|---|---|---|---|
| 4,560,154 | 12/1985 | Nogi et al. | 271/10 |
| 4,728,963 | 3/1988 | Rasmussen et al. | 346/25 |
| 4,759,649 | 7/1988 | Kelley et al. | 400/616.3 |
| 4,990,011 | 2/1991 | Underwood et al. | 400/636 |
| 5,000,594 | 3/1991 | Beehler et al. | 400/624 |
| 5,114,134 | 5/1992 | Rasmussen et al. | 271/34 |
| 5,172,989 | 12/1992 | Imaseki et al. | 400/641 |
| 5,178,378 | 1/1993 | Nakajima | 400/624 |
| 5,188,350 | 2/1993 | Hayashi | 271/114 |

FOREIGN PATENT DOCUMENTS

| | | | |
|---|---|---|---|
| 0401807 | 12/1990 | European Pat. Off. | 271/114 |

*Primary Examiner*—Edgar S. Burr
*Assistant Examiner*—Anthony H. Nguyen

[57] ABSTRACT

A sheet advancement system is provided which includes a roller arrangement having first and second rollers coupled to afford selected in-phase and out-of-phase relative rotational orientation thereof. Each roller includes a periphery with gripping and non-gripping surface regions, the gripping surface regions being configured to rotationally engage a sheet and the non-gripping surface regions being configured to clear the sheet. The rollers thus are joined in either a grip orientation wherein substantially continuous roller-directed sheet advancement is accommodated, or a pass orientation wherein the rollers permit unobstructed passage of the sheet. In the grip orientation, the rollers are out of phase, providing substantially continuous gripping region engagement of the sheet. In the pass orientation, the rollers are in phase, allowing for rotational adjustment of the rollers such that the non-gripping regions (or pass regions) of the rollers may be arranged to face the sheet so as to allow the sheet to pass beneath the rollers without roller drag.

18 Claims, 2 Drawing Sheets

SHEET ADVANCEMENT SYSTEM WITH PHASE-ADJUSTABLE ROLLER ARRANGEMENT

TECHNICAL FIELD

The present invention relates generally to sheet handling systems, and more particularly, to a system which advances sheet media along a path using a phase-adjustable roller arrangement. The invented system provides solutions to a variety of feed related problems, such problems being most directly addressed where the system employs a sheet pick-up arrangement which is distinct from the main sheet media drive. Although the system has broad utility, it is described below in the context of a single-sheet printer, a machine in which particular utility has been shown.

BACKGROUND

In a conventional printer, sheets are passed from the printer's input tray to its platen using a plurality of rollers which pull consecutive sheets from a sheet media stack. The rollers rotate against the upper surface of the stack, frictionally directing advancement of the stack's top sheet downstream along a predetermined sheet media path. The sheet is advanced through an infeed zone and into a processing zone for printing, and then is expelled through an output zone and the cycle is begun anew.

Despite the apparent simplicity of this procedure, various problems have arisen due to the mechanism by which most printers direct sheet How. Such problems are particularly prevalent during sheet media infeed, an operation which involves the pick-up and separation of media sheets. These tasks generally are accomplished using systems which continuously urge the input tray toward the rollers, resulting in a constant engagement of the rollers by to-be-fed sheets. Although effective in accomplishing sheet media pick-up, such systems have been troubled by problems such as sheet scarring, component wear, and excessive power drain. In addition, known systems have made it difficult to add sheet media to the input tray, and have encountered difficulties in adequately addressing the problem of sheet media skew.

One solution to these problems has been to employ separate roller arrangements for the pick-up and post-pick-up advancement of sheets. In such systems, pick-up rollers frictionally advance a sheet to a main drive roller (or post-pick-up roller), and then disengage the sheet media stack until it is necessary to advance the next sheet. The main drive roller is thus able to advance the sheet through a processing cycle without the power drain which is inherent in sheet media pick-up. An illustrative system is set forth in U.S. Pat. No. 4,990,011, which names Underwood et al. as inventors, and which is commonly owned herewith. That patent describes a circular main drive roller and a somewhat unconventional D-shaped pick roller which is configured for rotational orientation either to engage or clear the sheet. During sheet media pick-up, the pick roller engages the sheet. During sheet processing, the pick-up roller remains spaced from (or clears) the sheet. The disclosure contained in that patent is incorporated herein by this reference.

Although the use of D-shaped pick rollers is effective in reducing sheet media drag, such an arrangement raises new issues related to requirements of roller timing and size. This is particularly true in view of sheet skew, a problem which presents itself due to less-than-perfect frictional advancement of a sheet. Paper skew generally is corrected by reverse drive of a sheet's leading edge by the main drive roller arrangement while the sheet's trailing edge is held in place. Such reverse drive results in a sheet bulge which effectively biases the sheet's leading edge so as to correct sheet skew.

It will thus be appreciated that, where D-shaped pick rollers are employed, the pick rollers must be positioned at a precisely determined distance from the main drive roller so as to ensure that the sheet will be taken into the main drive roller just prior to the pick roller reaching the orientation in which the roller clears the sheet stack. The pick roller will thus be able to hold the sheet's trailing edge in position while the main drive roller is reversed. A slight pick roller rotation will then place the pick roller in an orientation in which it clears the sheet stack. D-shaped roller arrangements have thus required complex timing mechanisms to ensure that the roller is in the sheet-clearing orientation during processing of a sheet.

The size of a D-shaped roller is similarly precisely determined, it being necessary to ensure that a picked sheet reach the main drive roller before the pick roller's rolling surface clears the sheet. If the pick roller were to progress to the sheet-clearing orientation prior to the sheet reaching the drive roller, an intermittent pause in sheet advancement would result. Such a pause would lead to an undesirable noise and would potentially leave the sheet susceptible to increased sheet skew. D-shaped pick rollers have therefore been relatively large in size so as to provide for adequate advancement of sheets.

It is therefore a general object of the invention to provide a simple, yet effective, system for advancing sheets. More specifically, it is an object of the this invention to provide a sheet advancement system which employs a roller arrangement which addresses the problems associated with conventional sheet media pick-up without requiring complex timing mechanisms or rollers which are unnecessarily large.

SUMMARY OF THE INVENTION

The present invention addresses the above-identified problems by providing a sheet advancement system including a roller arrangement with first and second rollers, the rollers being coupled to afford selected in-phase and out-of-phase relative rotational orientation thereof. Each roller includes a periphery with gripping and non-gripping surface regions, the gripping surface region being configured to rotationally engage the sheet and the non-gripping surface region being configured to clear the sheet. The rollers thus are configured for coupling in either a grip orientation wherein substantially continuous roller-directed sheet advancement is accommodated, or a pass orientation wherein the rollers permit unobstructed passage of the sheet. When in the grip orientation, the rollers are out of phase, providing for substantially continuous gripping region engagement of the sheet during roller rotation. In the pass orientation, the rollers are in phase, allowing for rotational adjustment of the rollers such that the non-gripping regions of the rollers may be arranged to face the sheet so as to allow the sheet to pass the roller without roller drag.

The objects and advantages of the present invention will be more readily understood after a consideration of the drawings and the description of the preferred embodiment which follows.

DETAILED DESCRIPTION OF THE PREFERRED EMBODIMENT AND BEST MODE FOR CARRYING OUT THE INVENTION

As stated above, the present invention relates generally to feed systems of the type used to advance sheet media along a path. Although the system is described in the context of a single-sheet printer, those skilled will appreciate that the system is similarly useful in a variety of sheet processing machines, whether in a printing, faxing, copying or other applications where it is desired to pass sheets along a sheet media path.

Figure 1:
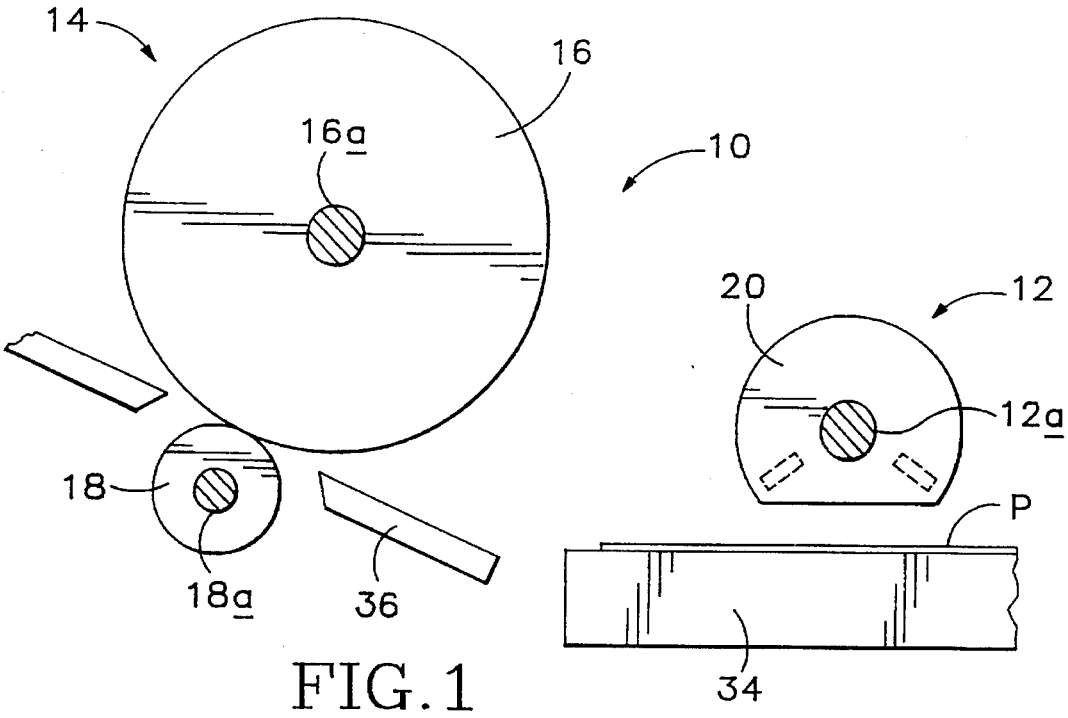
FIG. 1 is a simplified schematic diagram of a sheet advancement system employing a pick roller arrangement constructed in accordance with a preferred embodiment of the invention, the pick roller arrangement being shown during in-phase relative rotational orientation of its rollers.
Figure 2:
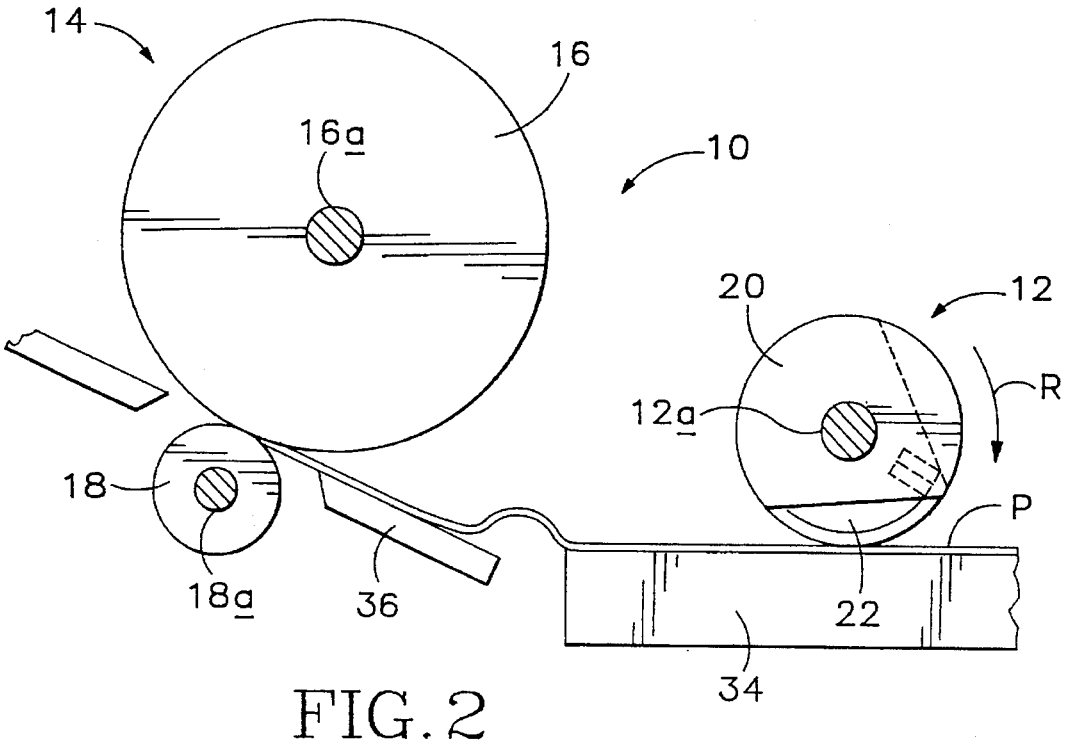
FIG. 2 is simplified schematic diagram similar to that of FIG. 1, but with the rollers of the pick roller arrangement shown in an out-of-phase relative rotational orientation.

Referring initially to FIGS. 1 and 2, the reader will note that a preferred embodiment of the invented sheet advancement system has been depicted, such system being indicated generally at 10. As shown, system 10 employs two distinct roller arrangements, a pick roller arrangement 12 which is adapted to pick-up ("pick") sheets from a sheet media stack, and a main drive roller arrangement 14 which is adapted to advance previously picked sheets. The pick roller arrangement is mounted adjacent a sheet media stack so as to provide for engagement with the stack's top sheet P which is selectively directed by the pick roller arrangement along a predetermined sheet media path. Sheet P is thus passed downstream (generally from right to left in FIGS. 1 and 2) to the main drive roller arrangement which in turn accepts the sheet for further advancement through the printer's processing zone.

The main drive roller arrangement and the pick roller arrangement are positioned such that the distance between the respective arrangements is less than the length of sheet P, it being necessary to ensure that the main drive roller arrangement receives the sheet before it leaves control of the pick roller arrangement.

In the preferred embodiment, the main drive roller arrangement is constructed to include a pair of opposing rollers 16, 18, each mounted for rotation with a corresponding shaft 16*a*, 18*a*. Roller 16 acts as a sheet-directing roller, the roller's peripheral surface being coated with a frictional material such as rubber so as to pull the sheet into the machine's processing zone. Roller 18 acts as a pinch roller, pinching sheets against the sheet-directing roller as they pass therebetween. The rollers are driven by a processor-controlled stepper motor (not shown), roller 16 being rotated clockwise (as viewed in FIGS. 1 and 2), and roller 18 being rotated counterclockwise (as viewed in FIGS. 1 and 2). The rollers thus may be considered to act in concert, the roller surfaces coming together in opposite rotations so as to define a nip which affords intake of the sheet.

Figure 3:
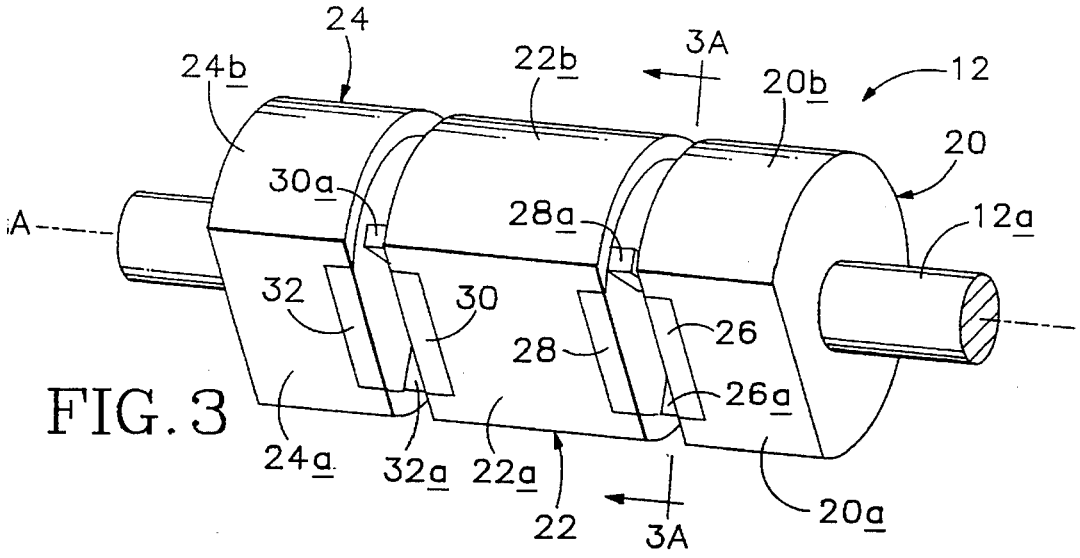
FIG. 3 is an isometric view of the preferred embodiment roller arrangement, the arrangement being shown with its rollers in the in-phase relationship of FIG. 1.
Figure 4:
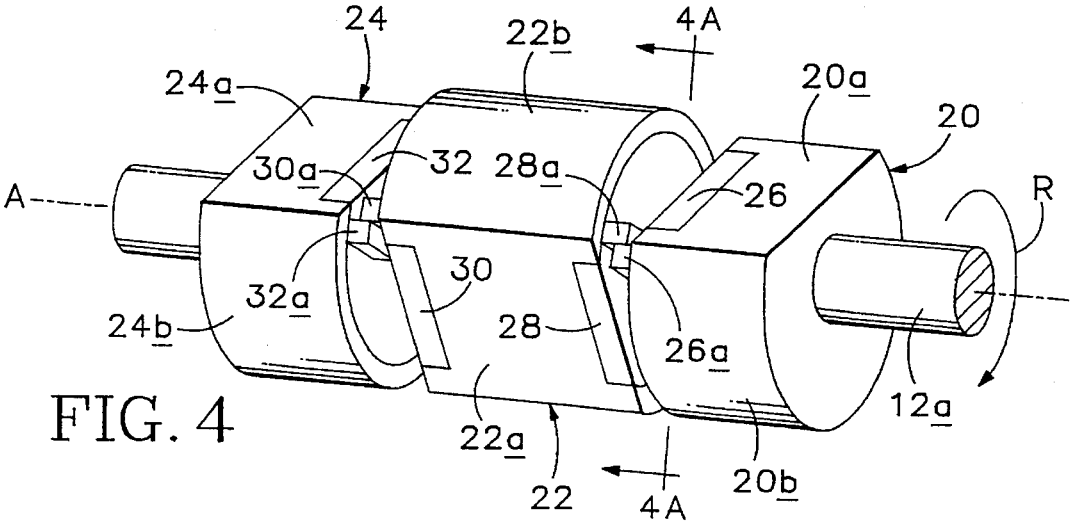
FIG. 4 is an isometric view of the preferred embodiment roller arrangement, the arrangement's rollers being shown in the out-of-phase relationship of FIG. 2.

Considering FIGS. 3 and 4, and referring to the system's pick roller arrangement 12, it will be noted that such arrangement preferably includes a plurality of pick rollers 20, 22, 24, each of which is of generally D-shaped form. It will thus be appreciated that the pick rollers are of similar cross-sectional shape, each having a periphery made up of a rectilinear (or flat) surface region and a curvilinear (or arcuate) surface region. The rectilinear surface regions 20*a*, 22*a*, 24*a* are non-gripping or sheet-passing surfaces, and the curvilinear surface regions 20*b*, 22*b*, 24*b* are gripping surfaces. The gripping surfaces preferably are defined by a frictionally adherent material such as rubber which is capable of gripping sheet media as will be described further below.

The pick rollers are mounted on a rotatable shaft 12*a*, rollers 20 and 24 being fixed to the shaft, and roller 22 being freely rotatable on the shaft. The pick rollers thus rotate about the shaft's axis of rotation A, fixed rollers 20, 24 further being characterized by driven rotation with the shaft under direction of a processor-controlled stepper motor (not shown). Although free roller 22 is freely rotatable on the shaft, a roller coupling is provided which selectively links the rollers so as to rotate free roller 22 with the shaft as will be described.

Figure 3A:
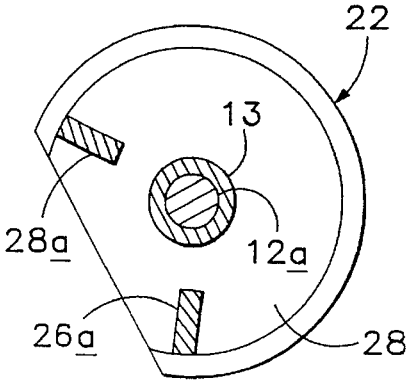
FIG. 3A is a sectional side view of the preferred embodiment roller arrangement taken generally along line 3A—3A of FIG. 3.
Figure 4A:
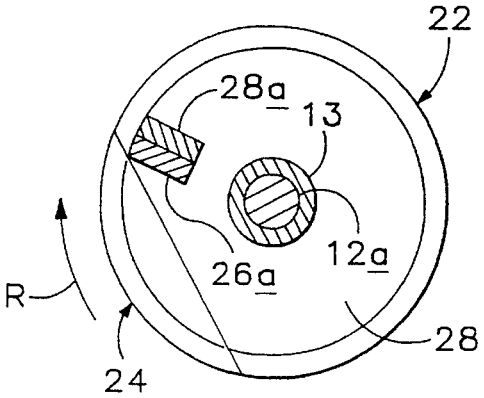
FIG. 4A is a sectional side view of the preferred embodiment roller arrangement taken generally along lines 4A—4A of FIG. 4.

In the preferred embodiment, free roller 22 is centrally mounted on shaft 12*a*, the roller including a bearing 13 which in turn is freely rotatable on the shaft. As indicated in FIGS. 3A and 4A, bearing 13 may be journalled within a decreased diameter region of the shaft so as to prevent lateral movement of the roller on the shaft. Fixed rollers 20, 24 are secured to the shaft on opposite sides of the free roller, the fixed rollers being closely adjacent to the free roller so as to define a roller arrangement which is mounted lengthwise symmetrically on the shaft.

Focusing next on the roller coupling, it is to be noted that each pick roller has associated therewith one or more inserts 26, 28, 30, 32, each roller's insert being adapted to join with an adjacent roller's insert so as to temporarily join the rollers in a predetermined relative rotational orientation. The inserts (also referred to as phase-defining members) are fixed to the rollers, each insert being secured to a roller's side for rotation with the roller as will be described below. Insert 26 is fixed to an interior side of roller 20, inserts 28 and 30 are fixed to opposite sides of roller 22, and insert 32 is fixed to an interior side of roller 24. The inserts thus may be considered to act in pairs, fixed roller insert 26 selectively joining with free roller insert 28, and fixed roller insert 32 selectively joining with free roller insert 30. Upon such joinder the fixed and free rollers will effectively be combined so as to rotate together in a phase relationship defined by the insert pairs.

Referring still to FIGS. 3 and 4, it is to be noted that each insert 26, 28, 30, 32 defines a corresponding laterally projecting tab 26*a*, 28*a*, 30*a*, 32*a*. Each tab projects toward an adjacent roller, the tabs in each insert pair being arranged for rotation about the pick roller shaft's axis A along a common rotational path. The tabs thus engage one another upon selected relative rotation of the rollers as illustrated in FIG. 4. Tabs 26*a* and 28*a* engage to join pick roller 22 and pick roller 20, and tabs 30*a* and 32*a* engage to join pick roller 22 and pick roller 24. The rollers join in a relative rotational orientation which is defined by the annular positions of the tabs relative to the rollers to which they are fixed. The preferred embodiment tabs are radially aligned with the edges of the rollers' flat surface regions, the fixed roller inserts employing tabs which extend from adjacent one edge and the free roller inserts employing tabs which extend from adjacent the other edge.

Having observed the structural details of the preferred embodiment pick roller arrangement, attention may now be given to pick roller arrangement's operation, such operation being illustrated by rotation of shaft 12*a* in the rotational direction R. This rotation effects passage of sheet P from an input tray 34, along a sheet media path (defined at least partially by a slide 36), and into a processing zone (not shown). Shaft 12*a* extends across the sheet media path, directing rotational frictional engagement of sheets by directing the pick rollers as will now be described.

Focussing first on FIG. 1, wherein the system is shown in its initial state, it will be appreciated that the pick roller arrangement 12 is shown with the pick rollers in a non-gripping orientation (or pass orientation), the rollers being in a substantially in-phase relative rotational orientation. As indicated, the non-gripping surface regions of all pick rollers are facing the stack's top sheet, the rollers clearing the sheets so as to afford unobstructed sheet media passage and ready loading and unloading of sheets. Such an in-phase relative rotational orientation is illustrated further by FIGS. 3 and 3A.

Upon rotation of shaft 12*a*, the fixed rollers will similarly rotate the peripheral surfaces of the fixed rollers 20, 24 eventually engaging sheet P so as to begin advancement of the sheet. Initially, roller 22 will remain stationary, there being nothing to drive rotation of roller 22 due to its freely rotatable mounting on shaft 12*a*. After a predetermined rotation, however, tab 26*a* will engage tab 28*a* and tab 32*a* will engage tab 30*a*, temporarily joining the fixed and free rollers in the out-of-phase relative rotational orientation (or grip orientation) shown in FIGS. 2, 4 and 4A. Free roller 22 will then begin to rotate with fixed rollers 20, 24. As indicated, the roller peripheries are arranged at this point such that a gripping region will confront the sheet throughout the 360° rotation of the shaft, providing for substantially continuous roller-directed advancement of sheet P. In the preferred embodiment, the tabs engage upon relative rotation of the fixed and free pick rollers of approximately 90°, such relative rotation effectively providing an arrangement in which a gripping surface region is always in contact with the sheet. This arrangement affords smooth transition of sheet P.

In order to correct skew problems, the pick roller arrangement preferably will be directed to overdrive sheet P, creating a buckle in the sheet as illustrated in FIG. 2. This is accomplished by overdriving the sheet while rollers 16 and 18 are held stationary. Once a skew-correcting sheet buckle is achieved, shaft 12*a* is paused and the main drive roller arrangement begins pulling the sheet. This will result in a drag on the fixed rollers, rotating both the fixed and free rollers in the direction indicated by arrow R until the fixed rollers' non-gripping surface regions face the sheet. The fixed rollers will then stop rotating, but the free roller will continue to rotate under pulling force of the sheet until its non-gripping surface region faces the sheet. Without any driving force from the fixed rollers, and without any pulling force from the sheet, the pick rollers will be paused with their pass regions facing the sheet stack, allowing subsequent unobstructed passage of the sheet.

In order to accurately determine the sheet position, the system may further include an optical sensor (not shown), the sensor being tripped upon predetermined advancement of the sheet. The sensor, for example, may be positioned immediately adjacent the sheet media nip. Upon passage of the sheet to the nip, the motor may be directed to pause, or delay, rotation of the shaft with subsequent advancement of the sheet pulling the rollers into the non-gripping rotational orientation so as to allow unobstructed passage of the sheet.

Industrial Applicability

As will be appreciated by those skilled in the art, the invented system is suited for use in a variety of machines, such system providing a low-cost solution to many of the problems associated with delivery of sheet media from a plural-sheet media stack. The system is small in size, simple in design, and may readily be incorporated into various existing sheet processing machines.

Where the invented system is employed, problems of sheet scarring, power drain and component wear are diminished, and the addition of media is made possible without halting operation of the machine. All this is accomplished without the necessity of intricate alignment mechanism, and without an undue increase in roller size.

While the present invention has been shown and described with reference to the foregoing operational principles in the preferred embodiment, it will be apparent to those skilled in the art that other changes in form and detail may be made therein without departing from the spirit and scope of the invention as defined in the appended claims.

I claim:

1. A sheet media advancement system for use in passing a sheet along a sheet media path, the sheet advancement system including a roller arrangement which comprises:

a first roller mounted for rotation about an axis which extends across the sheet media path, said first roller defining a periphery with gripping and non-gripping surface regions, and two end surfaces;

a second roller mounted for rotation about the axis which extends across the sheet media path, said second roller defining a periphery with gripping and non-gripping surface regions, and two end surfaces, an end surface of said first roller facing an end surface of said second roller; and a roller coupling consisting of contact surfaces projecting from each of said facing end surfaces, said contact surfaces being movable between engaged positions and disengaged positions to selectively place said rollers in an in-phase relative rotational orientation wherein said non-gripping surface regions of said first and second rollers face the sheet media path to afford passage of a sheet thereby, or an out-of-phase relative rotational orientation wherein said rollers are fixed relative to one another and rotate together with said gripping surface region of said first roller arcuately overlapping said non-gripping surface region of said second roller substantially throughout 360-degrees of rotation to provide for substantially continuous gripping surface region engagement of the sheet substantially throughout a sheet feed cycle wherein the sheet is passed entirely from the roller arrangement.

2. The sheet advancement system of claim 1, wherein said roller coupling includes a first phase-defining member which is fixed relative to said first roller and a second phase-defining member which is fixed relative to said second roller, said first and second phase-defining members being configured to join upon selected relative rotation of said rollers, providing for temporary combination of said rollers in a predetermined relative rotational orientation.

3. The sheet advancement system of claim 2, wherein said first phase-defining member includes a first tab and said second phase-defining member includes a second tab, said tabs being arranged for rotation along a common rotational path so as to engage one another upon said selected relative rotation of said rollers.

4. The sheet advancement system of claim 2, wherein said predetermined relative rotational orientation is said out-of-phase relative rotational orientation.

5. The sheet advancement system of claim 2, wherein said roller arrangement further comprises a rotatable shaft, said first roller being fixedly mounted on said shaft and said second roller being freely rotatable on said shaft.

6. The sheet advancing system of claim 5, wherein rotation of said shaft results in relative rotation of said first and second rollers until said combination of said first and second rollers, with continued rotation of said shaft effecting matching rotation of said first and second rollers throughout 360-degrees of roller rotation in said out-of-phase relative rotational orientation with substantially continuous, roller-directed advancement of the sheet.

7. The sheet advancement system of claim 1, wherein said gripping regions of said first and second rollers are of curvilinear cross-section.

8. The sheet advancement system of claim 1, wherein said non-gripping regions of said first and second rollers are of rectilinear cross-section.

9. The sheet advancing system of claim 1, wherein said first and second rollers are approximately 90-degrees out of phase when fixed in said out-of-phase relative rotational orientation.

10. A sheet media advancement system for use in picking a sheet from an input tray and passing such sheet along a sheet media path, the sheet advancement system including a main drive roller arrangement and a sheet pick roller arrangement, said sheet pick roller arrangement comprising:

a shaft mounted for selected rotation about an axis which extends across the sheet media path;

at least one fixed roller fixedly mounted on said shaft for rotation with said shaft, said fixed roller defining a peripheral surface which includes a gripping region configured to rotationally frictionally engage a sheet supported by the input tray and a sheet-passing region configured to clear the sheet, and two end surfaces;

at least one free roller mounted on said shaft and freely rotatable about the axis of said shaft, said free roller having a peripheral surface which matches said peripheral surface of said fixed roller, said free roller peripheral surface including a gripping region configured to rotationally frictionally engage the sheet and a pass region configured to clear the sheet, and two end surface, an end surface of said fixed roller facing an end surface of said free roller; and a freely adjustable roller coupling consisting of a first phase-defining member fixed relative to said fixed roller and a second phase-defining member fixed relative to said free roller, said first phase-defining member having a first tab projecting from an end surface of said fixed roller and said second phase-defining member having a second tab projecting from an end surface of said free roller, said first and second tabs being configured for rotation about the axis of said shaft along a common rotational path with rotation of said shaft resulting in operative engagement of said first and second tabs, such operative engagement effecting a temporary joinder of said fixed and free rollers in an out-of-phase relative rotational orientation wherein said tabs maintain said gripping region of said fixed roller in complete arcuately overlapping relation to said sheet-passing region of said free roller throughout 360-degrees of rotation to provide for substantially continuous fixed roller-directed advancement of the sheet along the sheet path to said main drive roller arrangement, said shaft selectively being configured to pause while said main drive roller arrangement continuous advancement of the sheet with the sheet frictionally pulling on any engaging gripping regions of said rollers to bring said fixed and free rollers into an in-phase relative rotational orientation wherein said sheet-passing regions of said fixed and free rollers facing the sheet so as to permit unobstructed continued passage of the sheet.

11. A sheet media advancement system for use in picking a sheet from an input tray and passing such sheet along a sheet media path, the sheet advancement system including a roller arrangement which comprises:

one or more fixed rollers mounted for rotation about an axis which extends across a supported sheet, each fixed roller having a periphery with gripping region configured to rotationally engage the sheet and a sheet-passing region configured to clear the sheet, and two end surfaces;

at least one free roller mounted for rotation about, the axis, each free roller having a periphery with a gripping region configured to rotationally engage the sheet and a sheet-passing region configured to clear the sheet, and two end surfaces, an end surface of each free roller facing an end surface of at least one of said fixed rollers; and a roller coupling consisting of contact surfaces projecting from each of said facing end surfaces, said contact surfaces being movable between engaged positions and disengaged positions to afford selected relative movement of said rollers into predefined grip and pass orientations, said grip orientation being defined by fixed combination of said rollers with said gripping surface regions of said fixed rollers collectively arcuately overlapping said sheet-passing region of said free roller substantially throughout a feed cycle wherein the sheet is passed entirely from the input tray so as to afford substantially continuous roller-directed sheet advancement, and said pass orientation being defined by arrangement of said sheet-passing regions of said fixed and free rollers to face the sheet to permit unobstructed passage of the sheet.

12. The sheet advancement system of claim 11, wherein said roller arrangement further comprises an elongate shaft which extends across the sheet, each fixed roller being fixedly mounted on said shaft and each free roller being freely rotatable on said shaft.

13. The sheet advancement system of claim 12, wherein said roller coupling contact surfaces consist of a tab which is fixed relative to a fixed roller, and a tab which is fixed relative to a free roller, said tabs being arranged for rotation about said shaft so as to engage one another upon selected relative rotation of said rollers, providing for temporary joinder of said rollers in a predetermined relative rotational orientation and thereby matching rotation of said rollers through 360-degrees of rotation.

14. The sheet advancement system of claim 13, wherein said predetermined relative rotational orientation of said fixed and free rollers provides for rotational engagement of the sheet by a fixed roller gripping region during clearance of the sheet by said free roller, and engagement of the sheet by a free roller gripping region during clearance of the sheet by said fixed roller.

15. The sheet advancement system of claim 13, wherein said predetermined relative rotational orientation is said grip orientation.

16. The sheet advancement system of claim 12, wherein said rollers are mounted on said shaft for symmetrical gripping engagement with the sheet relative to a central sheet axis.

17. The sheet advancement system of claim 12, wherein said roller arrangement includes a free roller mounted centrally on said shaft.

18. The sheet advancement system of claim 17, wherein said roller arrangement includes a pair of fixed rollers, said feed rollers being mounted oppositely adjacent said free roller.

* * * * *